US008813958B2

(12) United States Patent
Kuo et al.

(10) Patent No.: US 8,813,958 B2
(45) Date of Patent: Aug. 26, 2014

(54) PACKAGE BOX OF LIQUID CRYSTAL GLASS

(71) Applicant: Shenzhen China Star Optoelectronics Technology Co., Ltd., Shenzhen (CN)

(72) Inventors: Yicheng Kuo, Shenzhen (CN); Shihhsiang Chen, Shenzhen (CN); Gang Yu, Shenzhen (CN); Jiahe Cheng, Shenzhen (CN); Zhilin Zhao, Shenzhen (CN)

(73) Assignee: Shenzhen China Star Optoelectronics Technology co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 13/702,114

(22) PCT Filed: Oct. 10, 2012

(86) PCT No.: PCT/CN2012/082657

§ 371 (c)(1),
(2), (4) Date: Dec. 5, 2012

(87) PCT Pub. No.: WO2014/040326

PCT Pub. Date: Mar. 20, 2014

(65) Prior Publication Data

US 2014/0069834 A1 Mar. 13, 2014

(30) Foreign Application Priority Data

Sep. 11, 2012 (CN) ..... 2012 1 0334491

(51) Int. Cl.

| | |
|---|---|
| ***B65D 85/48*** | (2006.01) |
| ***B65D 81/02*** | (2006.01) |
| *B65D 81/05* | (2006.01) |

(52) U.S. Cl.

CPC ..... *B65D 81/022* (2013.01); *B65D 81/052* (2013.01); *B65D 81/02* (2013.01); *Y10S 220/92* (2013.01); *Y10S 220/921* (2013.01); *Y10S 220/918* (2013.01)

USPC ..... 206/454; 206/453; 206/524; 206/591; 206/592; 206/594; 220/920; 220/921; 220/918

(58) Field of Classification Search

CPC .... B65D 85/48; B65D 81/054; B65D 81/107; B65D 81/02; B65D 65/44; B65D 81/1075; B65D 81/113; H01L 21/67383; A45C 13/02; A45C 13/04

USPC ..... 206/453, 454, 558, 586, 583, 521, 449, 206/523, 591–594; 229/87.04; 220/920, 220/921, 918

See application file for complete search history.

(56) References Cited

U.S. PATENT DOCUMENTS

| | | | | |
|---|---|---|---|---|
| 2,861,681 | A * | 11/1958 | Lane | 206/453 |
| 3,283,988 | A * | 11/1966 | Hardigg | 206/521 |
| 7,210,579 | B2 * | 5/2007 | Fujioka et al. | 206/451 |
| 2008/0128310 | A1 | 6/2008 | Kao et al. | |

FOREIGN PATENT DOCUMENTS

| | | | |
|---|---|---|---|
| CN | 2611313 | Y | 4/2004 |
| CN | 2711086 | Y | 7/2005 |
| CN | 101195435 | A | 6/2008 |
| CN | 201128567 | Y | 10/2008 |
| CN | 102616488 | A | 8/2012 |
| KR | 20100129921 | A | 12/2010 |

OTHER PUBLICATIONS eSpacenet machine translation of CN 2011 28567.*

* cited by examiner

*Primary Examiner* — Andrew Perreault
*Assistant Examiner* — James M Van Buskirk
(74) *Attorney, Agent, or Firm* — Andrew C. Cheng

(57) ABSTRACT

The present invention provides a liquid crystal glass package box, which includes a box body, a plurality of mounting sections mounted inside the box body, and cushioning devices respectively mounted to the mounting sections. The cushioning devices each include a cushioning section and a receiving section connected to the cushioning section. The cushioning section includes an air pocket. The receiving section forms a receiving channel corresponding to the respective mounting section in order to mount the cushioning device in the box body. The liquid crystal glass package box provided by the present invention uses an air pocket to serve as a cushioning section mounted inside the box body to provide effective cushioning to liquid crystal glass for protecting the liquid crystal glass from damage during shipping. The raw material used is economic so as to effectively lower down the material cost. The structure is simple and is easy to manufacture.

10 Claims, 4 Drawing Sheets

PACKAGE BOX OF LIQUID CRYSTAL GLASS

BACKGROUND OF THE INVENTION

1. Field of the Invention

The present invention relates to the field of packaging material, and in particular to a package box of liquid crystal glass.

2. The Related Arts

In the field of manufacture of liquid crystal display devices, the manufacture of liquid crystal display devices includes a process of assembling, which assembles various components, including a liquid crystal glass, a main control circuit, and an enclosure, together. These components are each manufactured in advance and packaged for being later assembled to form a complete liquid crystal display device. The liquid crystal glass, after being manufactured, is packaged in a liquid crystal glass package box and then shipped, box by box, to a corresponding assembling station. Commonly used package boxes include paper boxes and plastic cases. Paper boxes have better cushioning property but are of poor stiffness for serving as liquid crystal glass package boxes. Plastic cases have better structures so as to not easily damage objects contained therein due to actions of external forces and are of low prices so as to be fit to packaging of fragile articles. However, plastic cases show poor cushioning performance so that cushioning blocks must be additionally provided inside the cases to effect cushioning.

As shown in FIGS. 1 and 2, a conventional liquid crystal glass package box comprises a box body 100, mounting sections 300 arranged inside the box body 100, and cushioning blocks 500 that are mounted on the mounting sections 300 and are arranged to engage a piece of liquid crystal glass. A packaged piece of liquid crystal glass is so set that a surface thereof is positioned on the cushioning blocks 500. In shipping the liquid crystal glass, the cushioning blocks 500 provide an effective protection to the liquid crystal glass and prevent the liquid crystal glass from being damaged by external forces.

Commonly used cushioning blocks are made of foaming substances, such as expandable polyethylene (EPE) and ethylene-vinyl acetate (EVA) copolymer. These cushioning substances are of high prices and are hard to spring back after being compressed, making the cushioning performance deteriorating and incapable of repeated use, so that the recycling value is low and cost control is difficult.

SUMMARY OF THE INVENTION

An object of the present invention is to provide a liquid crystal glass package box, which is capable of effectively protecting liquid crystal glass and has a simple structure and low cost.

To achieve the object, the present invention provides a liquid crystal glass package box, which comprises: a box body, a plurality of mounting sections mounted inside the box body, and cushioning devices respectively mounted to the mounting sections. The cushioning devices each comprise a cushioning section and a receiving section connected to the cushioning section. The cushioning section comprises an air pocket. The receiving section forms a receiving channel corresponding to the respective mounting section in order to mount the cushioning device in the box body.

The box body comprises a top cover and a bottom case mating the top cover. The mounting sections are fixed inside the bottom case.

The bottom case comprises a bottom board and side boards perpendicularly connected to the bottom board. The mounting sections are mounted to the bottom board at locations corresponding to opposite ends of each of the side boards.

The bottom case and the plurality of mounting sections are integrally formed.

Each of the mounting sections comprises two spaced projections. A distance between opposite sides of the two projections is greater than or equal to a length of the receiving channel.

The receiving channel is a through channel.

The cushioning devices each further comprise a connection section connecting the cushioning section and the receiving section.

The cushioning section, the receiving section, and the connection section are integrally formed of low density polyethylene.

The top cover and the bottom case are both made of plastics.

The air pocket is filled with air.

The present invention also provides a liquid crystal glass package box, which comprises: a box body, a plurality of mounting sections mounted inside the box body, and cushioning devices respectively mounted to the mounting sections, the cushioning devices each comprising a cushioning section and a receiving section connected to the cushioning section, the cushioning section comprising an air pocket, the receiving section forming a receiving channel corresponding to the respective mounting section in order to mount the cushioning device in the box body;

wherein the box body comprises a top cover and a bottom case mating the top cover, the mounting sections being fixed inside the bottom case;

wherein the bottom case comprises a bottom board and side boards perpendicularly connected to the bottom board, the mounting sections being mounted to the bottom board at locations corresponding to opposite ends of each of the side boards;

wherein the bottom case and the plurality of mounting sections are integrally formed;

wherein each of the mounting sections comprises two spaced projections, a distance between opposite sides of the two projections being greater than or equal to a length of the receiving channel;

wherein the receiving channel is a through channel;

wherein the cushioning devices each further comprise a connection section connecting the cushioning section and the receiving section;

wherein the cushioning section, the receiving section, and the connection section are integrally formed of low density polyethylene;

wherein the top cover and the bottom case are both made of plastics; and wherein the air pocket is filled with air.

The efficacy of the present invention is that the present invention provides a liquid crystal glass package box, which uses an air pocket to serve as a cushioning section mounted inside a box to provide effective cushioning to liquid crystal glass for protecting the liquid crystal glass from damage during shipping. The raw material used is economic so as to effectively lower down the material cost. The structure is simple and is easy to manufacture.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to a preferred embodiment of the present invention and the attached drawings.

Figure 1:
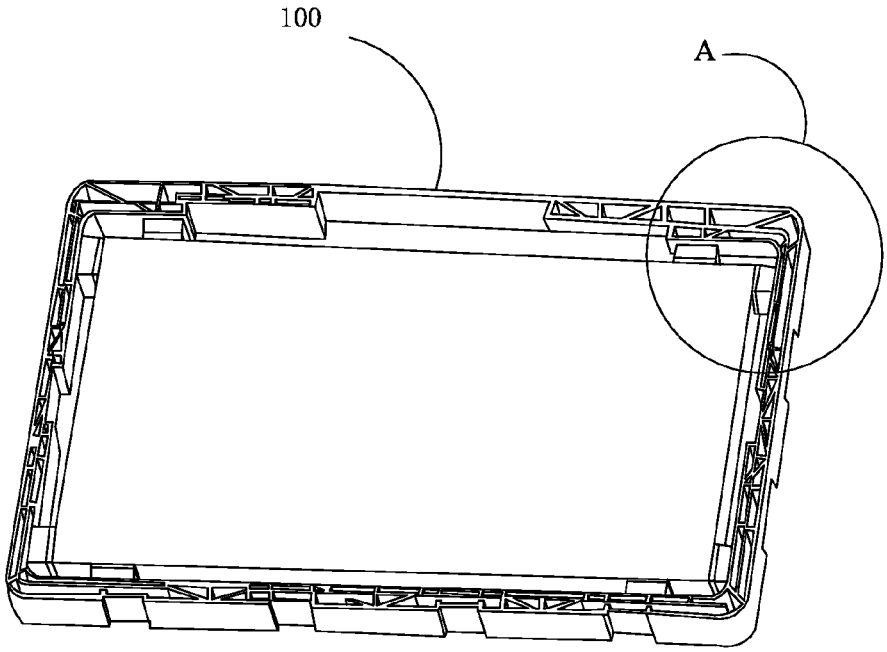
Fig. 1 (Prior Art)
FIG. 1 is a schematic view illustrating a conventional package box of liquid crystal glass.
Figure 2:
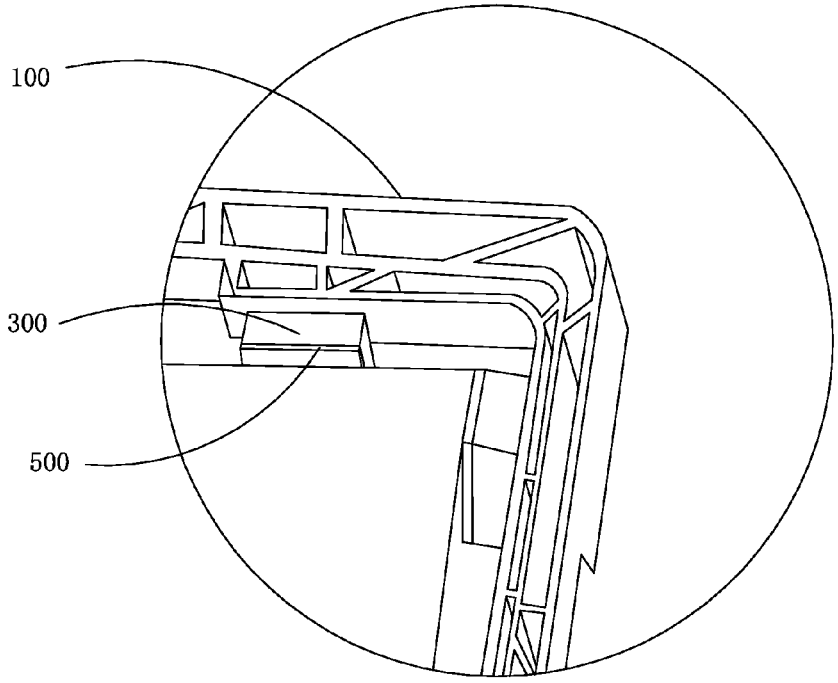
Fig. 2 (Prior Art)
FIG. 2 is an enlarged view of circled portion A of FIG. 1.
Figure 3:
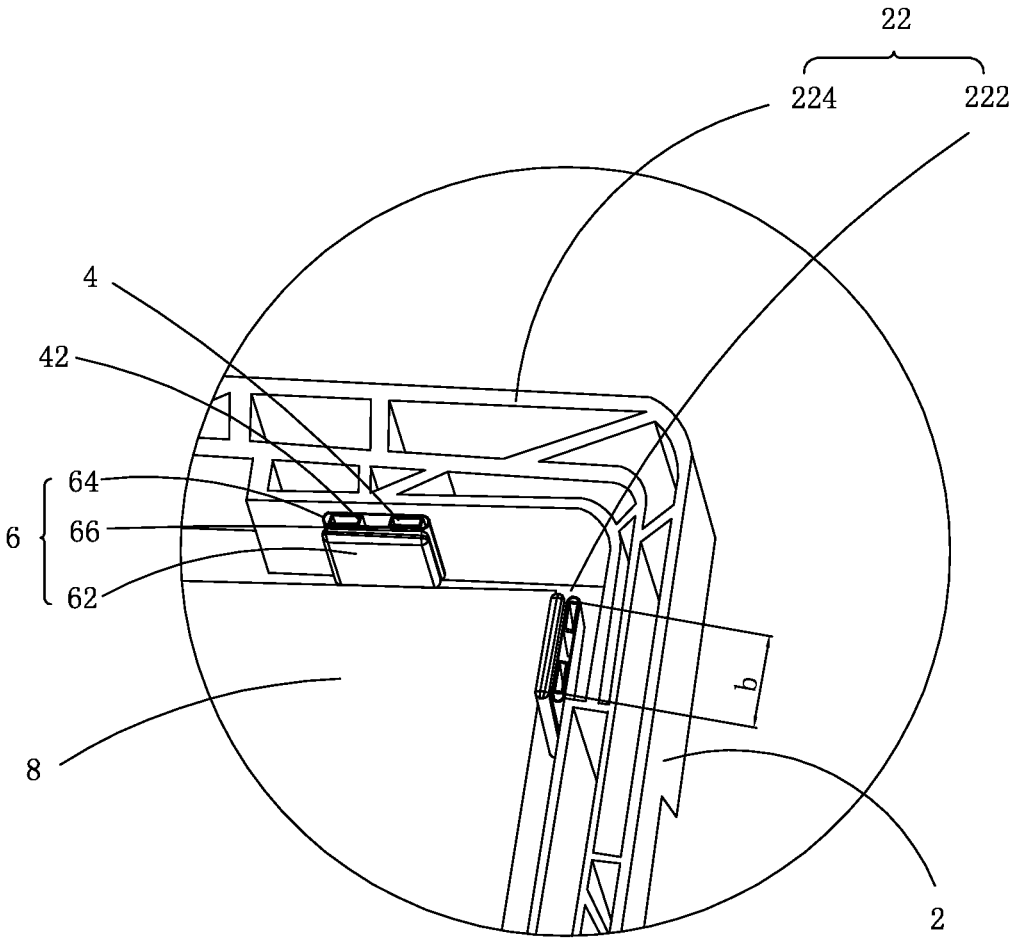
FIG. 3 is schematic view showing a portion of a liquid crystal glass package box according to the present invention.
Figure 4:
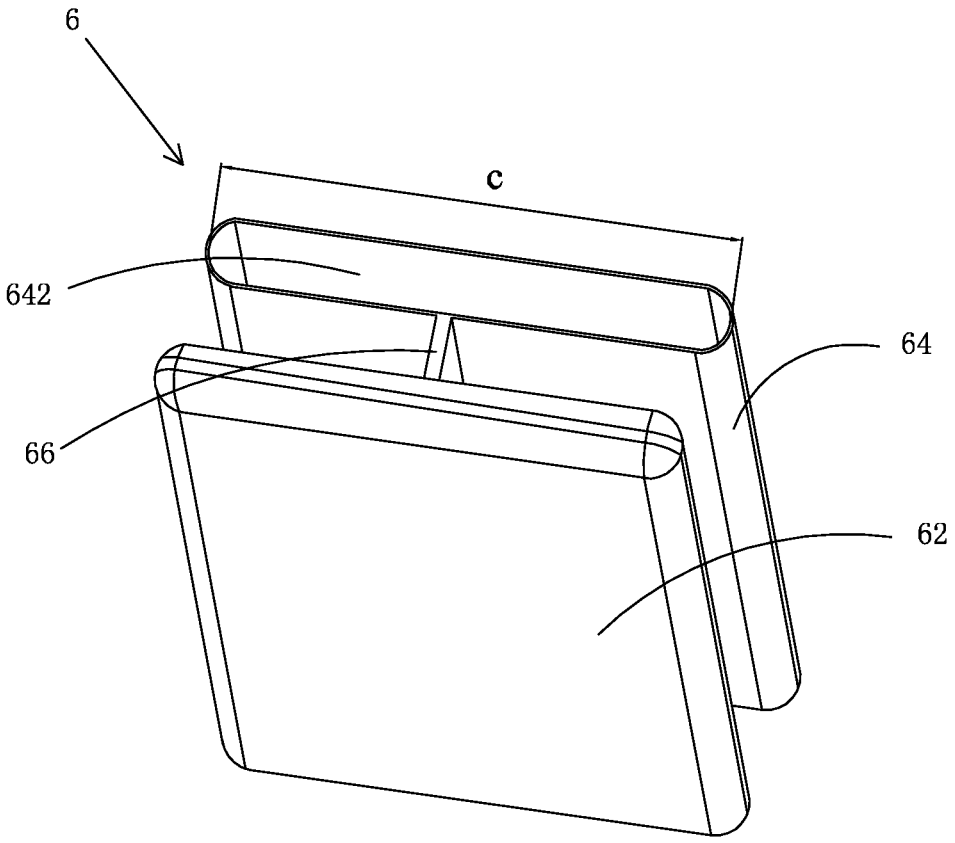
FIG. 4 is a schematic view showing the structure of a cushioning device of the liquid crystal glass package box according to the present invention.

Referring to FIGS. 3 and 4, the present invention provides a liquid crystal glass package box, which comprises a box body 2, a plurality of mounting sections 4 arranged in the box body 2, and cushioning devices 6 mounted to the mounting sections 4. The cushioning devices 6 each comprise a cushioning section 62 and a receiving section 64 connected to the cushioning section 62. The cushioning section 62 comprises an air pocket. The receiving section 64 forms a receiving channel 642 corresponding to the respective mounting section 4. To assemble, the mounting sections 4 are put in the receiving channels 642 so as to fix the cushioning devices 6 inside the box body 2. When a piece of liquid crystal glass 8 is deposited in the box body 2, a surface of the liquid crystal glass 8 is positioned on the cushioning sections 62. During shipping, the liquid crystal glass 8 may compress the cushioning sections 62 and the gas contained in the cushioning sections 62 effectively provides a cushioning effect to protect the liquid crystal glass 8 against damage.

The box body 2 may comprise a top cover (not shown) and a bottom case 22 mating the top cover. The mounting sections 4 are fixed inside the bottom case 22. The bottom case 22 comprises a bottom board 222 and side boards 224 perpendicularly connected to the bottom board 222. The mounting sections 4 are mounted to the bottom board 222. Preferably, the mounting sections 4 are arranged at locations corresponding to opposite ends of each of the side boards 224.

The bottom case 22 and the plurality of mounting sections 4 are integrally formed. Each of the mounting sections 4 comprises two spaced projections 42. The distance "b" between opposite sides of the two projections 42 is greater than or equal to length "c" of the receiving channel 642. Preferably, the distance "b" between the opposite sides of the two projections 42 is slightly greater than the length of the receiving channel 642. The receiving section 64 is made of an elastic material so that the receiving section 64 can be mounted to the corresponding mounting section 4 without being easily detached from the mounting section 4 in order to maintain the effect of cushioning. The receiving channel 642 is a through channel so that the two projections 42 are completely receivable in the receiving channel 642.

The cushioning devices 6 each further comprise a connection section 66 connecting the cushioning section 62 and the receiving section 64. The cushioning section 62, the receiving section 64, and the connection section 66 are integrally formed of low density polyethylene and have a simple structure and low cost so as to be favorable for cost control.

The top cover and the bottom case 22 are both made of plastics. The plastic box has a structure that is better than ordinary paper boxes, allows of repeated use without easy breaking, resist against humidity and water, and provides bettered protection. And, repeated use of the package box offers a saving of packaging cost.

The cushioning section 62 is an air pocket that is filled with air. Before filling of air, the cushioning section 62 is of a form of film, which occupies a small amount of space in storage and shipping so as to lower down the costs of storing and shipping the packaging material.

In summary, the present invention provides a liquid crystal glass package box, which uses an air pocket to serve as a cushioning section mounted inside a box to provide effective cushioning to liquid crystal glass for protecting the liquid crystal glass from damage during shipping. The raw material used is economic so as to effectively lower down the material cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A liquid crystal glass package box, comprising: a box body, a plurality of mounting sections mounted inside the box body, and cushioning devices respectively mounted to the mounting sections, the cushioning devices each comprising a cushioning section and a receiving section connected to the cushioning section, the cushioning section comprising an air pocket, the receiving section forming a receiving channel corresponding to the respective mounting section in order to mount the cushioning device in the box body;

wherein each of the mounting sections comprises two spaced projections, a distance between opposite sides of the two projections being greater than a length of the receiving channel of the receiving section, the receiving section being made of an elastic material and thus expandable for being mounted to the spaced projections to be securely attached thereto.

2. The liquid crystal glass package box as claimed in claim 1, wherein the box body comprises a top cover and a bottom case mating the top cover, the mounting sections being fixed inside the bottom case.

3. The liquid crystal glass package box as claimed in claim 2, wherein the bottom case comprises a bottom board and side boards perpendicularly connected to the bottom board, the mounting sections being mounted to the bottom board at locations corresponding to opposite ends of each of the side boards.

4. The liquid crystal glass package box as claimed in claim 3, wherein the bottom case and the plurality of mounting sections are integrally formed.

5. The liquid crystal glass package box as claimed in claim 1, wherein the receiving channel is a through channel.

6. The liquid crystal glass package box as claimed in claim 1, wherein the cushioning devices each further comprise a connection section connecting the cushioning section and the receiving section.

7. The liquid crystal glass package box as claimed in claim 6, wherein the cushioning section, the receiving section, and the connection section are integrally formed of low density polyethylene.

8. The liquid crystal glass package box as claimed in claim 2, wherein the top cover and the bottom case are both made of plastics.

9. The liquid crystal glass package box as claimed in claim 1, wherein the air pocket is filled with air.

10. A liquid crystal glass package box, comprising: a box body, a plurality of mounting sections mounted inside the box body, and cushioning devices respectively mounted to the mounting sections, the cushioning devices each comprising a cushioning section and a receiving section connected to the cushioning section, the cushioning section comprising an air pocket, the receiving section forming a receiving channel corresponding to the respective mounting section in order to mount the cushioning device in the box body;

wherein the box body comprises a top cover and a bottom case mating the top cover, the mounting sections being fixed inside the bottom case;

wherein the bottom case comprises a bottom board and side boards perpendicularly connected to the bottom board, the mounting sections being mounted to the bottom board at locations corresponding to opposite ends of each of the side boards;

wherein the bottom case and the plurality of mounting sections are integrally formed;

wherein each of the mounting sections comprises two spaced projections, a distance between opposite sides of the two projections being greater than a length of the receiving channel, the receiving section being made of an elastic material and thus expandable for being mounted to the spaced projections to be securely attached thereto;

wherein the receiving channel is a through channel;

wherein the cushioning devices each further comprise a connection section connecting the cushioning section and the receiving section;

wherein the cushioning section, the receiving section, and the connection section are integrally formed of low density polyethylene;

wherein the top cover and the bottom case are both made of plastics; and wherein the air pocket is filled with air.

* * * * *